US005931035A

United States Patent [19]

Bolton

[11] Patent Number: 5,931,035

[45] **Date of Patent: *Aug. 3, 1999**

[54] CYLINDER TYPE LOCK ARRANGEMENT

[75] Inventor: Brian L. Bolton, Kirksville, Mo.

[73] Assignee: Ortech Co., Kirksville, Mo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/601,585

[22] Filed: Feb. 14, 1996

[51] Int. Cl.[6] ..... E05B 27/00

[52] U.S. Cl. ..... 70/367; 70/370; 70/379 R

[58] Field of Search ..... 70/367–373, 379 R, 70/380, 38 A, 451, DIG. 42; 292/336.5, DIG. 23, DIG. 42, DIG. 43, DIG. 52, DIG. 53, DIG. 67

[56] References Cited

U.S. PATENT DOCUMENTS

| | | | |
|---|---|---|---|
| 1,741,093 | 12/1929 | Briggs | 70/367 |
| 1,853,403 | 4/1932 | Briggs | 70/367 |
| 1,968,555 | 7/1934 | Horne | 70/367 |
| 2,655,028 | 10/1953 | Jacobi | 70/367 |
| 2,955,865 | 10/1960 | Leslie et al. | 292/DIG. 67 X |
| 3,212,307 | 10/1965 | Hallgren | 70/373 X |
| 3,270,151 | 8/1966 | Godette | 70/372 |
| 3,589,152 | 6/1971 | Glass | 70/371 X |
| 3,626,729 | 12/1971 | Fane et al. | 70/370 X |
| 4,381,656 | 5/1983 | Hayakawa | 70/370 X |
| 4,530,222 | 7/1985 | Harper | 70/DIG. 42 X |
| 4,550,580 | 11/1985 | Neyret | 70/370 |
| 4,566,350 | 1/1986 | Miyamoto et al. | 292/DIG. 53 X |
| 4,890,467 | 1/1990 | Krause et al. | 70/369 |
| 4,910,982 | 3/1990 | Dana | 70/370 |
| 5,186,029 | 2/1993 | Myers | 70/371 X |
| 5,235,832 | 8/1993 | Lux et al. | 70/368 |
| 5,363,678 | 11/1994 | Meckbach | 70/379 R X |
| 5,413,392 | 5/1995 | Schlack et al. | 70/379 R X |

FOREIGN PATENT DOCUMENTS

| | | | |
|---|---|---|---|
| 2227787 | 8/1990 | United Kingdom | 70/370 |
| 2245643 | 1/1992 | United Kingdom | 70/370 |

*Primary Examiner*—Suzanne Dino Barrett
*Attorney, Agent, or Firm*—Michael D. Bednarek; Kilpatrick Stockton LLP

[57] ABSTRACT

To prevent a key cylinder from being punched out of an automotive door or the like and to simplify assembly, a stepped key cylinder retention cavity structure that is rigid with an outer panel of the door, is arranged to extend into the interior of the door. A key cylinder is disposed in the cavity from outside of the door so that a shaft that rotates synchronously with a rotor of the key cylinder, extends through an opening formed in an inboard end of the cavity and is connected to a key lever through a lost motion connection that allows for key backlash. The key lever is connected to the cavity structure by resilient barbed members that can be pressed in through the opening from the interior of the door. The barbed members snap into a locking position in suitable recesses formed in the structure. Rotation-limiting projections that are rigid with the structure are provided to limit the amount of rotation of the key lever. Vehicle assembly can be facilitated by connecting the key lever to the cavity structure and inserting the key cylinders into position at a later time such as upon delivery to a dealer. A dummy key can be temporarily inserted and used to lock and unlock the door as required prior to the actual key cylinder being inserted into place.

4 Claims, 6 Drawing Sheets

CYLINDER TYPE LOCK ARRANGEMENT

BACKGROUND OF THE INVENTION

1. Field of the Invention

The present invention relates generally to a key cylinder arrangement for use with locks and the like type of devices. More specifically, this invention relates to a key cylinder arrangement for automotive application wherein a key cylinder is adapted to be inserted into a retention cavity from outside of a structure such as a vehicle door, ignition switch or the like, and which features a simple and robust construction.

2. Description of the Prior Art

Automotive door locks usually take the form of a cylinder type lock arrangement that consists of a key cylinder and a rotor rotatably supported within the cylinder. A key lever is typically connected to the rear or inboard end of the rotor, and a door lock device is operatively connected by way of a rod to the key lever. A cylinder type door lock is arranged such that the key lever is operable via the key cylinder only when a matching key is inserted.

There are problems with this type of known structure. In particular, since the key lever rotates together with the rotor of the key cylinder it is necessary to replace both the key cylinder and the key lever if the rod displacement changes with a change in vehicle door type, etc. For this reason, it has been difficult to use exactly the same parts under all conditions and this has led to a greater number of parts being required for a given number of different vehicle types and has contributed to higher production cost.

This problem has been exacerbated by the fact that this type of prior art door lock structure requires a rod holder, an additional part, to connect the key lever to the rod, and thus further increases the number of parts required.

A further problem has been encountered in that the key cylinder, or the handle assembly that contains it, normally is installed from the outside of the door panel with no automatic means of retention, thus necessitating a contemporaneous retention operation from inside the door panel, which, in turn requires installation of the key cylinder early in the overall assembly process of the vehicle, in particular, before the outer and inner door panels are fastened together and installed on the automobile, which, in turn, sometimes leads to an assembled automobile with mismatched key cylinders.

A further problem is that retention of the key cylinder is often so weak that application of a strong external force can overcome the structural strength of the retention means allowing the key cylinder to be "punched out" in a manner that allows unauthorized entry into the vehicle.

A further problem is that keys are sometimes lost in transit from the manufacturer to the dealer.

SUMMARY OF THE INVENTION

An object of this invention is to provide a lock arrangement that features a key cylinder support structure that does not readily yield to the application of large external forces and thus prevents the key cylinder from being "punched out".

A further object of this invention is to provide a key cylinder arrangement that simplifies the rod assembling process.

Yet another object of this invention is to provide a key cylinder arrangement that enables an increased use of common parts and a minimization in the number of changes needed to adjust the key lever rotation angle.

A further object of this invention is to provide a key cylinder which can be inserted into a door or other structure and automatically retained therein so that the insertion of the key cylinder can be carried out in one of the final steps in the overall automobile assembly process or could even occur after the assembly process, such as after delivery to the dealer, so as to minimize the possibility of mismatched keys during the automobile assembly process and lost keys in transit to the dealer, respectively.

Still another object of the invention is to provide a key dummy that can be temporarily inserted into a key cylinder receiving cavity and used to operate the lock until such time as it is desired to fit the actual key cylinders into place.

In brief, the above objects can be achieved by a stepped key cylinder retention cavity structure that is rigid with an outer panel of a door (compartment closure member) or the like type of structure, which is arranged to extend into the interior of the door. A key cylinder is inserted into the cavity from outside of the structure so that a shaft that rotates synchronously with a rotor of the key cylinder, extends through an opening formed in an inboard end of the cavity and is connected to a key lever through a lost motion connection that allows for key backlash. The key lever is connected to the cavity structure by resilient barbed members that can pressed in through the opening from the interior of the structure. The barbed members snap into a locking position in suitable recesses formed in the structure. Rotation-limiting projections that are rigid with the structure, are provided to limit the amount of rotation of the key lever. Vehicle assembly can be facilitated by connecting the key lever to the cavity structure and inserting the key cylinders into position at a later time such as upon delivery to a dealer. A dummy key can be temporarily inserted and used to lock and unlock the associated lock mechanism (door, ignition or the like), as required prior to the actual key cylinder being inserted into place.

More specifically, a first aspect of the invention resides in a key cylinder arrangement comprising: a key cylinder retention cavity structure having inboard and outboard end portions and defining a key cylinder retention cavity therein, the retention cavity structure being rigid with an outer panel of a door body or like type of structure, and having an opening at the inboard end portion; a key cylinder assembly, including a cylinder, a rotor, and a shaft, the rotor and the shaft being rotatable with respect to the cylinder when a key is inserted into the rotor which is secured in the key cylinder retention cavity so that the shaft extends through the opening in the inboard end portion; and a member which is rotatably attached to the cylinder retention cavity, operatively connected with the shaft, and adapted for operative connection to a predetermined device such as a door lock, ignition switch or the like.

A further feature of the above mentioned key cylinder arrangement resides in that the key cylinder retention cavity structure has a contour and in that the rotatable member takes the form of a key lever which is bent in a manner to extend back along beside the external profile of the key cylinder retention cavity structure.

Another feature of the above mentioned key cylinder arrangement resides in that it includes a rotation-limiting projection that is rigid with the key cylinder retention cavity structure and is arranged to engage the rotatable member and limit the amount of rotation of the rotatable member (e.g., key lever) with respect to the key cylinder retention cavity structure in a predetermined direction.

Still another feature of the above mentioned key cylinder arrangement comes in that the rotatable member and the shaft are connected in a manner that defines a lost motion connection between the shaft and the member and that allows a predetermined amount of relative rotation to occur between the two members before drive motion is transmitted therebetween.

Yet another feature of the above mentioned key cylinder arrangement resides in that it further comprises slot means formed in the key cylinder retention cavity structure; a projection formed on the external periphery of the key cylinder; and a resilient clip which is disposed through the slot means and which engages the projection in a manner that locks the key cylinder in the key cylinder retention cavity.

A further feature of the above mentioned key cylinder arrangement is that the resilient clip has an essentially C-shape and has resilient leg portions that are curved in a manner to engage outer peripheral portions of the key cylinder.

A still further feature of the above mentioned key cylinder arrangement is that the resilient clip is formed with an essentially rectangular portion at its closed end which facilitates removal of the clip from the slot means.

Another aspect of the above mentioned key cylinder arrangement is that the key cylinder retention cavity structure is stepped and has a step formed at the outboard end portion of the key cylinder retention cavity structure, and wherein the key cylinder is formed with a flange that seats on the step in a manner that provides the key cylinder with resistance to externally applied forces that tend to drive the key cylinder into the interior of the door.

A second aspect of the invention resides in a method of mounting a key cylinder arrangement for a door or the like type of arrangement which comprises: forming a stepped key cylinder retention cavity structure to be rigid with an outer panel of a door body and to have an opening in an inboard end portion thereof; disposing a key cylinder assembly in a key cylinder retention cavity defined by the key cylinder retention cavity structure so that a shaft that is rigid with a rotor of the key cylinder assembly extends through the opening; providing a rotatable member such as a rotatable shaft or key lever with rotatable attachment means; pressing the member against an inboard surface of the key cylinder retention cavity structure so that the member becomes rotatably attached; providing a rotation-limiting projection that is rigid with the key cylinder retention cavity structure to limit the amount of rotation of the member with respect to the key cylinder retention cavity structure; and forming the connection between the member and the shaft to provide a lost motion connection that permits the member to rotate by a predetermined amount with respect to the shaft before operative engagement is established therebetween.

A third aspect of the present invention resides in a key cylinder arrangement comprising: a stepped key cylinder retention cavity structure that is rigid with an outer panel of a door body and which has an opening in an inboard end portion thereof; a key cylinder disposed in a key cylinder retention cavity defined by the key cylinder retention cavity structure so that a shaft which is rigid with a rotor of the key cylinder extends through the opening; a key lever with rotatable attachment means, the key lever being attached to the key cylinder retention cavity structure so as to be rotatable with respect to the key cylinder retention cavity structure by pressing the key lever against the key cylinder retention cavity structure so that the rotatable attachment means engages with a surface of the key cylinder retention cavity structure; a rotation-limiting projection that is rigid with the key cylinder retention cavity structure and which limits the amount of rotation of the key lever with respect to the key cylinder retention cavity structure; and connection means between the key lever and the shaft for providing a lost motion connection that permits the key lever to rotate by a predetermined amount with respect to the shaft lever before operative engagement is established therebetween.

A feature of this aspect of the invention resides in that the key cylinder further comprises a flange formed at an outboard end of the key cylinder, the flange seating on a step of the stepped key cylinder retention cavity structure; and resilient packing disposed between the flange and the step.

A fourth aspect of the invention resides in a key lever assembly comprising: a first member; a key lever, the key lever having a first end and a second end, the first end being rotatably connectable to the first member, the second end having a stop and a hole from which relief grooves are respectively formed in opposite sides of the second end so as to extend in opposite directions from the hole; and a second member operatively connected to the second end by insertion of a portion of the second member through the hole while aligned with the relief grooves, the second member, after such insertion, being rotatable over the stop.

A fifth aspect of the invention resides in a lock arrangement comprising: a structure which defines a cavity into which a key cylinder can be disposed; a lever rotatably supported on the structure; and a temporary key unit which can be used in lieu of an actual key cylinder until it is desired to insert the key cylinder, comprising a key head, a body which is received in the cavity, and a shaft which extends from the body and which operatively engages with the lever in a manner wherein the lever is pivoted in response to rotation of key head.

A further feature of this aspect of the invention resides in that the lever includes connection means for providing a self-interlocking snap together connection when the lever is pressed against the structure.

As will be appreciated, the invention features the formation of a stepped key cylinder retention cavity that is rigid with the door panel and such as to protrude inwardly from the outer panel of a given body such as a door or the like, so that the key cylinder can be supported rigidly on both stepped and bottom surfaces of the cavity. That is to say, a flange provided on an outboard portion of the key cylinder and a step provided in the mouth of the key cylinder retention cavity are such that externally applied forces are not only resisted by an inwardly extending flange formed at the bottom of the cavity but also by engagement between the step and the flange on the key cylinder. Furthermore, the provision of a gasket between the key cylinder flange and the step in the key cylinder retention cavity not only prevents infiltration of water and dirt but also prevents rattling of the fully assembled key cylinder.

The key cylinder device according to this invention facilitates the assembly of the key lever by providing a resilient latching member on the key lever and a corresponding latching feature on the key cylinder retention cavity structure. With this arrangement, the key lever can be previously connected to a lock operating rod, and the combined rod and lever simply pressed into an operative engagement 1) with a shaft which is rigid with the rotor of the key cylinder and 2) the structure that defines the stepped key cylinder retention cavity, thus facilitating the overall assembling process. Moreover, the need for a rod holder part for connecting the key lever to the rod is obviated thus contributing to a reduction in the number of parts.

As will further be appreciated, if the key lever is bent to conform with the contour of the cylinder retention structure, the amount of protrusion is reduced and the door can be made thinner. This of course contributes to an overall weight reduction of the door and therefore the vehicle.

In addition, it will be appreciated that the angle through which the key lever can be rotated is limited by a rotation-limiting structure that forms part of the structure that defines the reception cavity. Accordingly, the angle of rotation of the key lever can be easily adjusted by simply changing the shape and dimensions of the key lever and/or the rotation-limiting structure. Therefore, any need to change the rod displacement, i.e., the rotation angle of the key lever, due to a change in the vehicle manufactured can be easily accommodated, thus facilitating the use of common parts and cost reduction. Further, simply by varying the shape and dimensions of the rotation-limiting opening in the key lever, it is possible to readily set the key backlash.

BRIEF DESCRIPTION OF THE DRAWINGS

The various features and advantages of the present invention will become more clearly appreciated from the following description taken in conjunction with the appended drawings in which.

DETAILED DESCRIPTION

Figure 1:
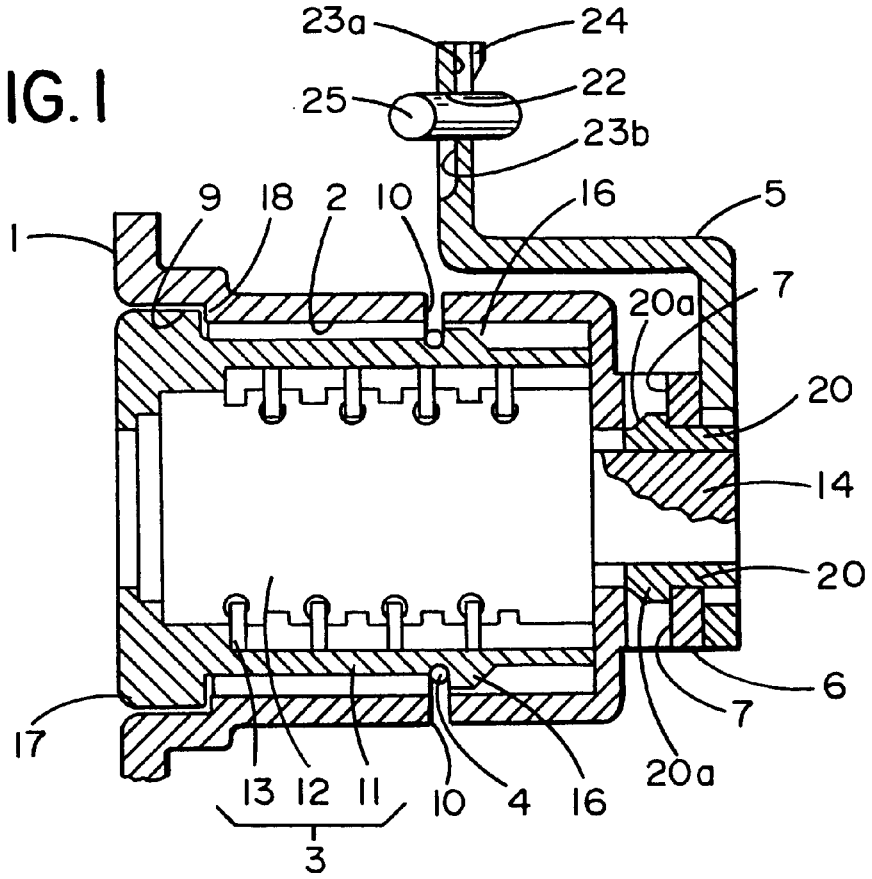
FIG. 1 is a side sectional view of an embodiment of the invention
Figure 2:
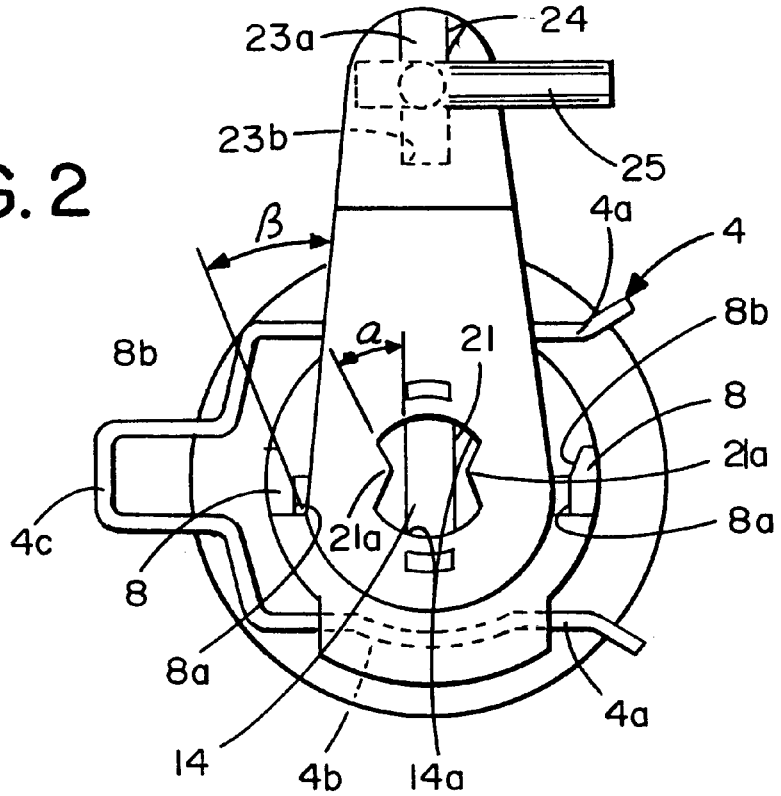
FIG. 2 is an end elevation of the arrangement shown in FIG. 1.
Figure 3:
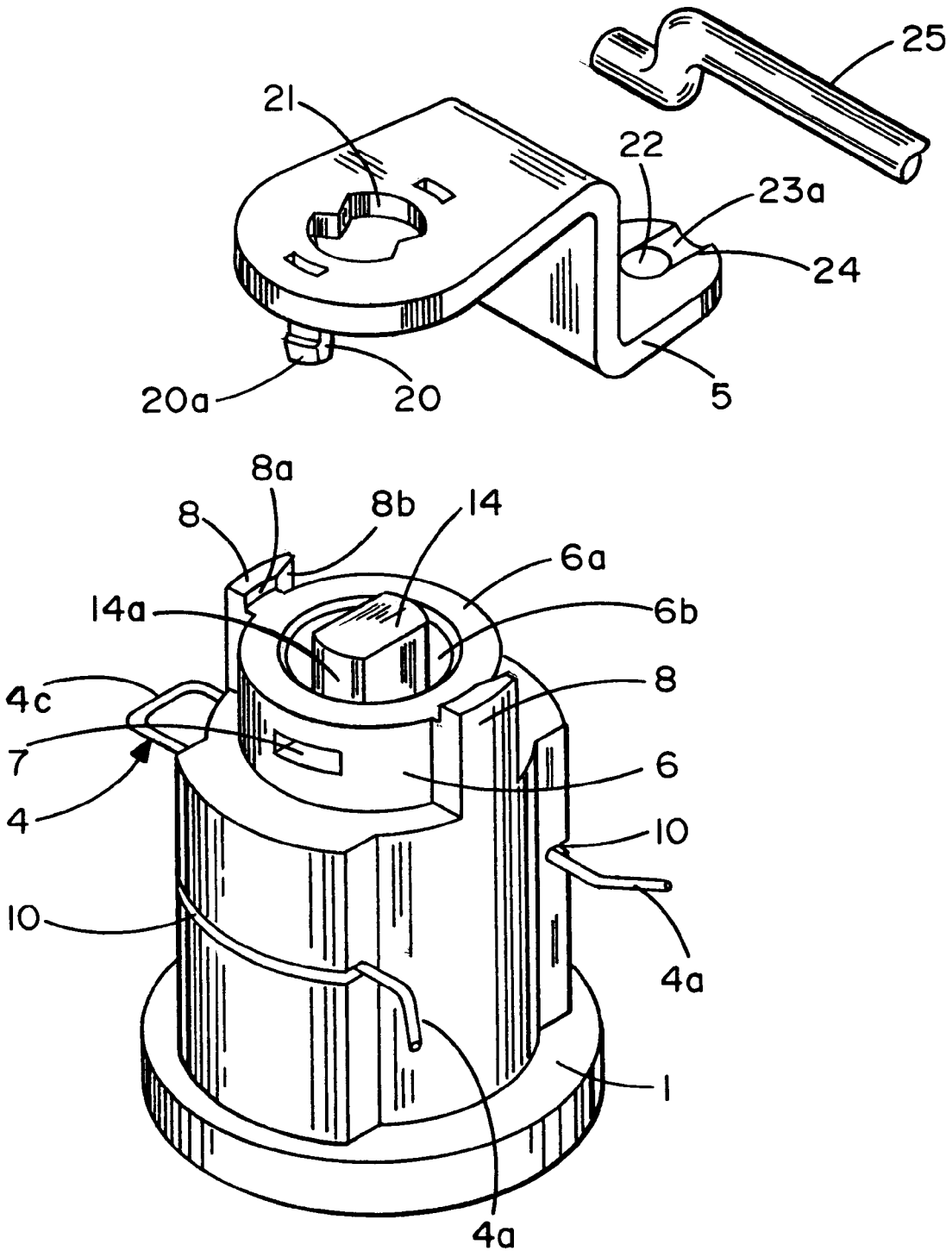
FIG. 3 is a perspective partially exploded view of the arrangement shown in FIGS. 1 and 2 showing features of the structure that characterizes the embodiment of the invention.

FIGS. 1 to 3 shows a key cylinder mechanism according to the invention as applied to the door lock mechanism of an automotive door. However, from the outset it should be noted that the present invention is not limited to vehicle doors per se and can be well applied to trunk lids, glove compartment doors, ignition switches and the like type of arrangements.

As shown in FIGS. 1 to 3, this arrangement, which in this particular instance is adapted for use with vehicle door locks, basically includes a structure 1 in which key cylinder retention cavity 2 is defined; a key cylinder 3 that is disposed within the cavity 2; a retaining clip 4 that locks the key cylinder in the retention cavity; a key lever 5 that is connected to an inboard end portion of the key cylinder; and a lock operating rod 25 that is connected to the free end of the key lever 5. In this instance, the key cylinder cavity defining structure is adapted to be rigid with an exterior door panel or like structural member of the door.

In this particular embodiment, the structure 1 is formed by zinc die casting (by way of example only) and the key cylinder retention cavity 2 defined therein has a stepped configuration that is arranged to extend inwardly into the interior of the door in a manner which terminates in an annular portion 6. This annular portion 6 forms an inwardly extending flange 6*a* (best seen in FIG. 3) and defines an opening 6*b* at the bottom of key cylinder retention cavity 2. As shown in FIG. 3, a pair of arcuate latch openings 7 of a specific length are formed in diametrically opposing positions in a side wall of the annular portion 6. Also, a pair of protruding rotation-limiting stops 8 are provided in diametrically opposed positions and arranged to extend an amount essentially equal to the thickness of the key lever 5, beyond the level of the annular portion 6. Each of these rotation-limiting stops 8 has a face portion 8*a* and a contiguous inclined surface 8*b*.

A step portion 9 is provided in the mouth of the key cylinder retention cavity 2, while a pair of openings 10 are provided in a diametrically opposed relationship to each other in the side wall of the structure 1 that defines key cylinder retention cavity 2.

The key cylinder 3 consists of cylinder 11 and rotor 12 placed inside cylinder 11. When a key (not shown) is inserted into a rotor 12, tumblers 13 that are normally engaged with the inner surface of cylinder 11 are withdrawn into rotor 12 from their engaging positions, thus rendering the rotor 12 freely rotatable.

A rotatable shaft 14 is provided at the rear or inboard end of the rotor 12. This shaft 14 extends out through the opening 6*b* defined by the annular portion 6. In this embodiment the shaft 14 has an essentially rectangular cross-section and is formed with slightly arcuate surfaces 14*a*. The reason for this configuration will become apparent later in the disclosure.

A pair of latching projections 16 are provided on the outer circumference of cylinder 11. The upper edges of latching projections 16 are arranged to locate approximately flush with the lower edge of the engaging openings 10 when key cylinder 3 is disposed in the key cylinder retention cavity 2. Moreover, an outwardly extending flange 17 that is formed at the leading or outboard edge of the cylinder 11, is dimensioned so as to seat in the step portion 9. An O-ring or gasket 18 is disposed between the flange 17 and step portion 9 and arranged to be elastically compressed by the disposition of the key cylinder 3 in the key cylinder retention cavity 2 in a manner that prevents the infiltration of external water and dirt.

In this illustrated embodiment, the retaining clip 4 is made by bending a spring steel rod of suitable diameter into a C-clip configuration having a rectangular-shaped closed end, outwardly flared free end portions 4*a*, and outwardly curved intermediate portions 4*b* that are adapted to slip through the engaging openings 10 and seat on the outer circumference of cylinder 11, in the manner illustrated in FIG. 1, when the cylinder 11 is slid into the illustrated position.

The mid-portion of the closed end of the retaining clip is bent so as to have a rectangular portion adapted to facilitate the removal of the clip in the event that it is required to remove the key cylinder from the recess.

In this illustrated embodiment, the key lever 5 has an L-shaped crank configuration and is provided with a pair of latching tabs 20. As illustrated in FIG. 3, each of these latching tabs 20 has a ramped portion 20*a* formed on its leading edge that is adapted to engage the inwardly extending flange 6*a*. The key lever 5 includes a rotation-limiting opening 21 comprising diagonally arranged protrusions 21*a*.

As shown in FIG. 2, this opening 21 is located in the key lever 5 between the latching tabs 20 and is shaped such that the arcuate surfaces 14*a* can slide on the inner circumference of the rounded end portions of this rotation-limiting opening 21 and establishes a lost motion connection which allows the key lever 5 to rotate freely within a predetermined limited range.

As shown in FIG. 1, when the key lever 5 is assembled on key cylinder 3, the crank configuration allows the lever to extend back along beside the external profile of the structure 1 defining key cylinder retention cavity 2 and does not protrude further into the door body from the level of the end of the shaft 14.

In this illustrated embodiment, a connection hole 22 is provided at the distal end of key lever 5. Relief grooves 23*a* and 23*b* are respectively formed in opposite sides of the key lever and arranged to extend in the same direction. A stop 24 is formed on one edge of relief groove 23*a*. One end of rod 25 is bent into a crank shape, and is connected to key lever 5 via insertion though the connection hole 22 by way of the relief groove 23*a*. After connection is established, the lever is rotated so as to ride over the stop 24 and assume the position illustrated in FIG. 2.

The key cylinder arrangement according to this invention features the following assembly technique:

The key lever 5 and rod 25 are connected by inserting rod 25 through hole 22. Once key lever 5 is in place, simply rotating key lever 5 over the stop 24 prevents the rod 25 from rotating back toward the relief grooves 23*a* and 23*b*, so that the connection will not be disturbed during transportation to the assembly site, etc.

The key lever 5 is connected to the structure 1, simply by inserting its latching tabs 20 through opening 21 so that the latching tabs 20 are deflected inwardly by the annular portion 6 as they move past the inwardly extending flange 6*a*. Upon reaching the latch openings 7, the inwardly deflected latching tabs 20 spring back so that the ramped portions 20*a* lock in the openings 7 by engaging with a side of the flange 6*a*.

The retaining clip is slipped into position. Once the above steps have been completed, the initial stages of assembly are complete.

When it is desired to insert the key cylinder 3, the key cylinder 3, with the gasket or O-ring 18 in place, is inserted from the outside of the door body until further movement is resisted by the resilient gasket 18 that is sandwiched and compressed between the outwardly extending flange 17 of the cylinder 11 and the step portion 9. Under these conditions, the key cylinder 3 is received completely within key cylinder retention cavity 2. As will be appreciated, as the inboard end of the key cylinder 3 approaches the bottom of key cylinder retention cavity 2, the elastic legs of the C-shaped retaining clip 4, which are located in the engaging openings 10, are forced apart by the protruding latching parts 16 formed on the outer circumference of cylinder 11. After the latching parts 16 have passed by the retaining clip 4, these legs spring back to their original positions to engage the upper side surfaces of the latching parts 16, thus preventing the key cylinder 3 from coming out of the retention cavity 2.

In accordance with the present invention, it is possible to arrange the inboard side of the latching parts to be ramped at an angle which facilitates the passage of the latching parts past the retaining clip 4, and for the outboard edge to be ramped at a predetermined steep angle (e.g. 5° with respect to a line radially normal to the axis of the key cylinder 3) so that the intermediate portions 4*b* of retaining clip 4 rest on these ramped edges in a manner which allows for production tolerances. This arrangement, in combination with the resiliency of the gasket or O-ring 18, ensures the key cylinder is snugly retained in the cavity 2 in a rattle free manner.

It will also be noted that once the key cylinder 3 is inserted into the position illustrated in FIGS. 1 and 2, the shaft 14 is such as to extend between the latching tabs 20 in a manner which prevents their inward deflection and snugly locks the key lever 4 in its operative position.

Under these conditions, the shaft 14 of rotor 12 is located in the rotation-limiting opening 21 of key lever 5 and so that rotation-limiting stops 8 are located on both sides of key lever 5. When key lever 5 is in a neutral position such as shown in FIG. 2, it is possible for the key lever 5 to rotate relative to the shaft 14 in either direction through an angle of a before engagement between the lever 5 and the shaft 14 occurs. The key lever 5 is also such that it can rotate from the above mentioned neutral position through an angle of $\beta$ in either direction before engaging the rotation-limiting stops 8. It will of course be understood that under normal conditions, the key lever 5 would be located in one of its extreme positions and has been illustrated in the above mentioned "neutral" position to simply facilitate the discussion of the amount of relative movement which is possible between the key lever 5 and the shaft 14, and the key lever 5 and the rotation-limiting stops 8.

In the fully assembled state, a spring (not shown) which is included in the key cylinder 3, biases a rotor which is included in the key cylinder 3 and rigid with the shaft 14, toward a neutral position such as illustrated in the figures. In this particular embodiment, the key lever 5 would normally assume a position wherein one of the angled sides of the opening 21 would be engaged with one of the sides of the shaft 14.

When the key is inserted into rotor 12, it retracts the tumblers 13 to allow rotor 12 to rotate when the key is turned. This rotation either drives the key lever 5 immediately or rotates the shaft 14 until the shaft 14 abuts an opposite side surfaces of the rotation opening 21. Following this abutment, the key lever 5 is driven to rotate until its side edge abuts against a slope 8*b* of a rotation-limiting stop 8, at which point the door lock operation is completed via the rod 25 and no further rotation is permitted.

In other words, rotating the key in one direction locks the door while rotating the key in the opposite direction unlocks the door. The total rotating angle of the key is $\alpha+\beta$. In each case, the angle $\alpha$ provides for backlash. It will be noted that the length of the arcuate latching openings 7 must be selected to avoid any interference that will interfere with the above-mentioned amounts of rotation.

Therefore, by changing angles $\alpha$ and $\beta$ by means of changing the shapes of key lever 5 and rotation-limiting stops 8, the maximum key rotation angle as well as the maximum rotation angle of key lever 5 and the maximum displacement of the rod 25 can be arbitrarily changed.

Although key cylinder 3 is inserted from the outside of the door, the key lever 5 can have the same general structure as above even if it is designed to be assembled from the inside as in the case of the prior art discussed supra.

As will be appreciated from the preceding disclosure it is preferred to firstly connect the key lever 5 to the lock actuating rod 25 and then to the retention cavity defining structure 1, by inserting the latching tabs 20 past the inwardly extending flange 6*a* until they are able to engage in the latch openings, and then wait until at least the inner and outer panels of the door are assembled in place and the door is hung on the vehicle frame, before actually inserting the key cylinder into place.

This delayed insertion the key cylinder is highly advantageous in that it facilitates vehicle production and assembly and assists in preventing accidental key losses and/or mismatches between keys and cylinders which are apt to occur during the production of a large number of vehicles and/or the delivery of the vehicles to different dealers. In other words, it enables the keys and the key cylinders to be kept together until such time as the vehicle is ready for transport from the site of manufacture and/or is actually delivered to the dealer for sale.

ALTERNATIVE EMBODIMENTS

The key cylinder retention cavity 2 can be formed as part of an outer handle mounting plate that is attached to the outer door panel, or in the form of a member that can be retained (or bonded in the case of fiber glass panels) to an appropriately shaped outer door panel.

Figure 4:
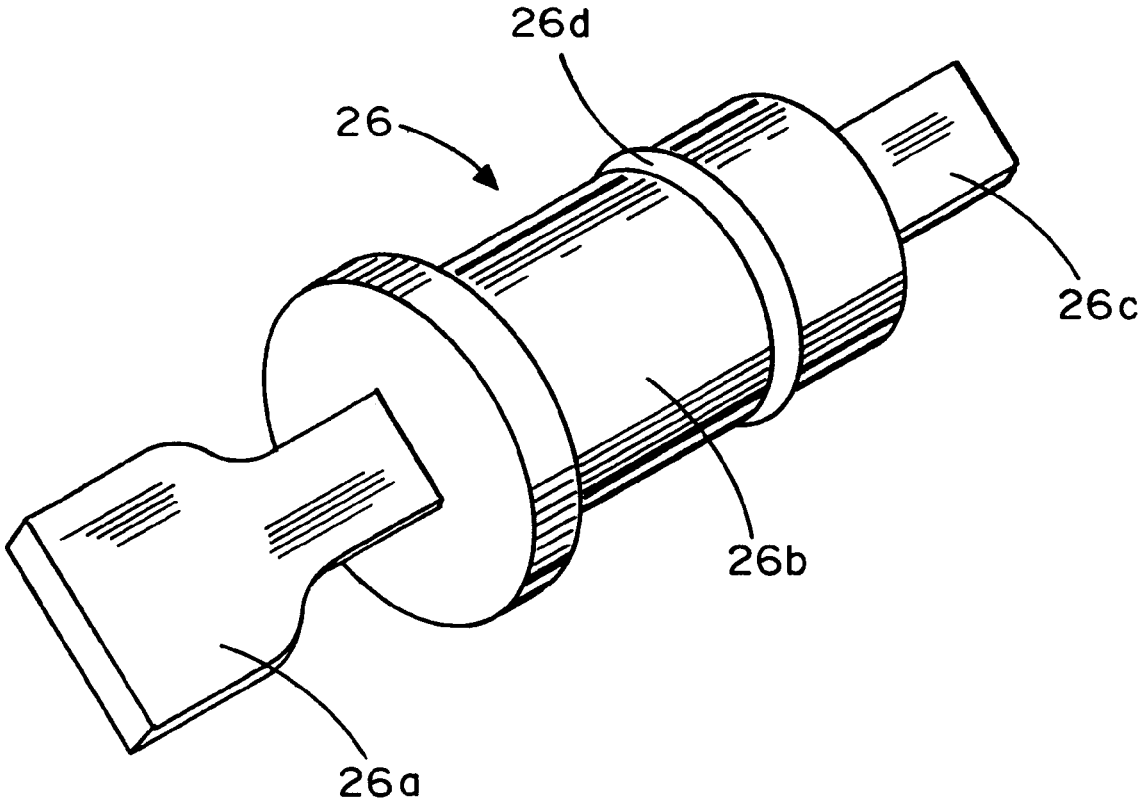
FIG. 4 is a perspective sketch of a dummy key arrangement which can be temporarily used in place of a key cylinder during production and/or transportation of vehicles equipped with the present invention.

In order to facilitate locking and unlocking of the doors prior to the actual insertion of the key cylinders, it is within the scope of the invention to provide a temporary key dummy arrangement 26 which is constructed in the manner depicted in FIG. 4. As shown, this key dummy is an integral unit having a key head 26*a*, a body 26*b* which is essentially the same shape and dimensions as the key cylinder 3, and a shaft portion 26*c* which is adapted to engage in the rotation-limiting opening 21 of the key lever 5. With this dummy arrangement 26 it is possible to temporarily insert it into place instead of the actual key cylinder so that release of the door lock is facilitated. In order to facilitate the dummy key removal when it is time to actually fit the real key cylinder, a ridge or a series of intermittent nubs 26*d* which is formed on the body of the unit, is arranged to have ramped surfaces and/or dimensions which permit the key dummy to be manually pulled past the retaining clip 4 with the application of only a suitably small force.

By way of example only, the key dummies could be issued to drivers who drive the vehicles from the assembly line to the transports which take the vehicles to the dealers. This would obviate the problem which is sometimes induced by the drivers losing sets of keys. The dealers could also be issued with key dummies in order to enable the vehicles to be unloaded from the transport.

Figure 5:
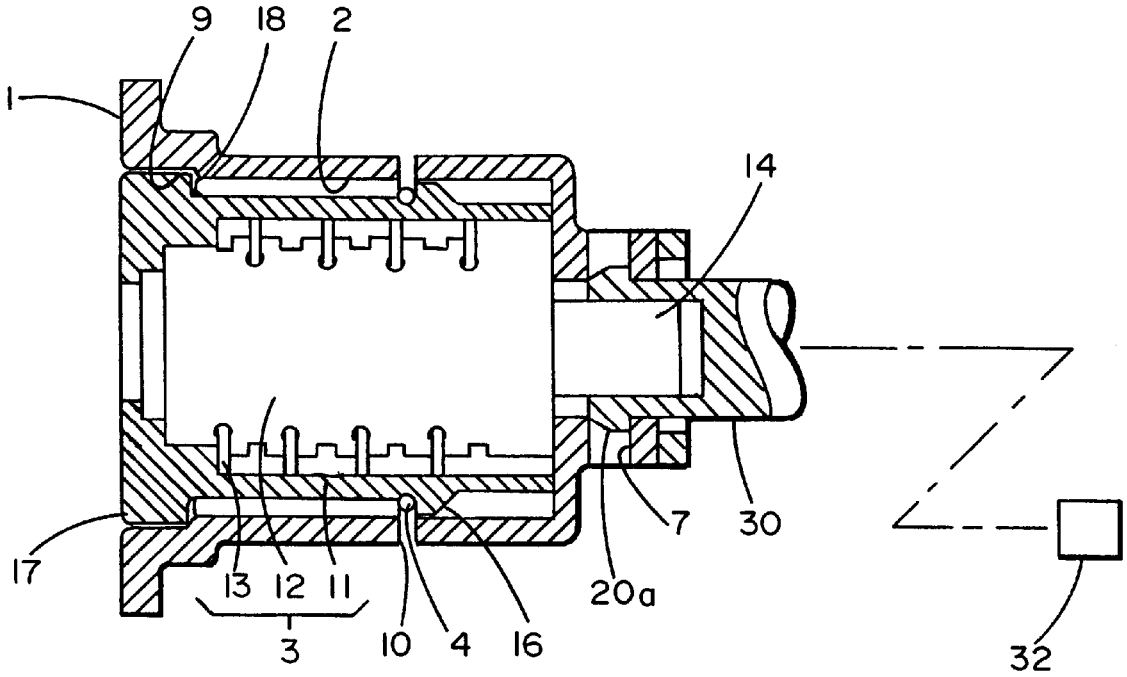
FIG. 5 is a sectional view similar to that shown in FIG. 1, illustrating an embodiment of the invention applied to an ignition switch.

FIG. 5 shows the invention applied to an ignition switch arrangement. In this arrangement, a shaft 30 replaces the key lever 5 and is operatively connected with a switch mechanism 32. The lost motion connection is omitted in this embodiment in that direct drive is preferred and in that the provision for backlash is not needed.

As an alternative to the retaining clip 4 in FIG. 5, it may be advantageous to use a spring biased pin of the type that is known to those skilled in the art. In addition, the need for retaining tabs 20*a* can be eliminated if the shaft is attached to an element in the steering column (as is conventionally the case).

It will also be noted that under certain circumstances the lost motion connection between the key lever 5 and the shaft 14 will not be required. For example, in some environments it will be preferred to provide the lost motion arrangement at the other end of the lock operating rod 25. In these instances the opening 21 will have the same configuration as the cross-section of the shaft 14. In other instances, such as a trunk lock, lost motion might not be necessary.

Figure 6:
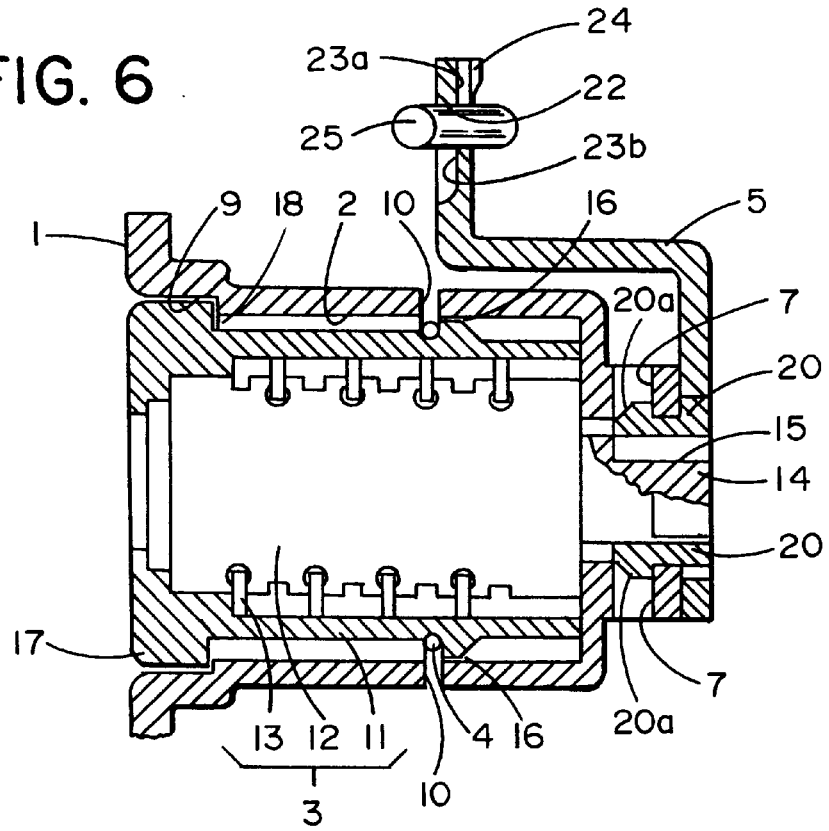
FIGS. 6 to 8 show a further embodiment of the invention which adapted to permit the key lever to be selectively disengaged from its operative position, or permit the insertion of the key cylinder into its operative position prior the connection of the key lever.
Figure 7:
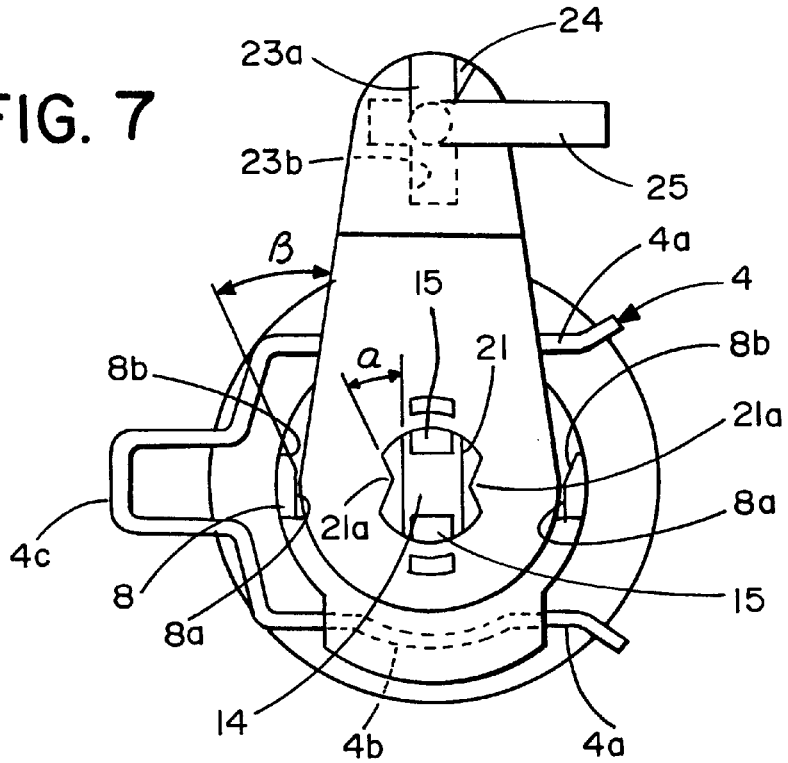
Figure 8:
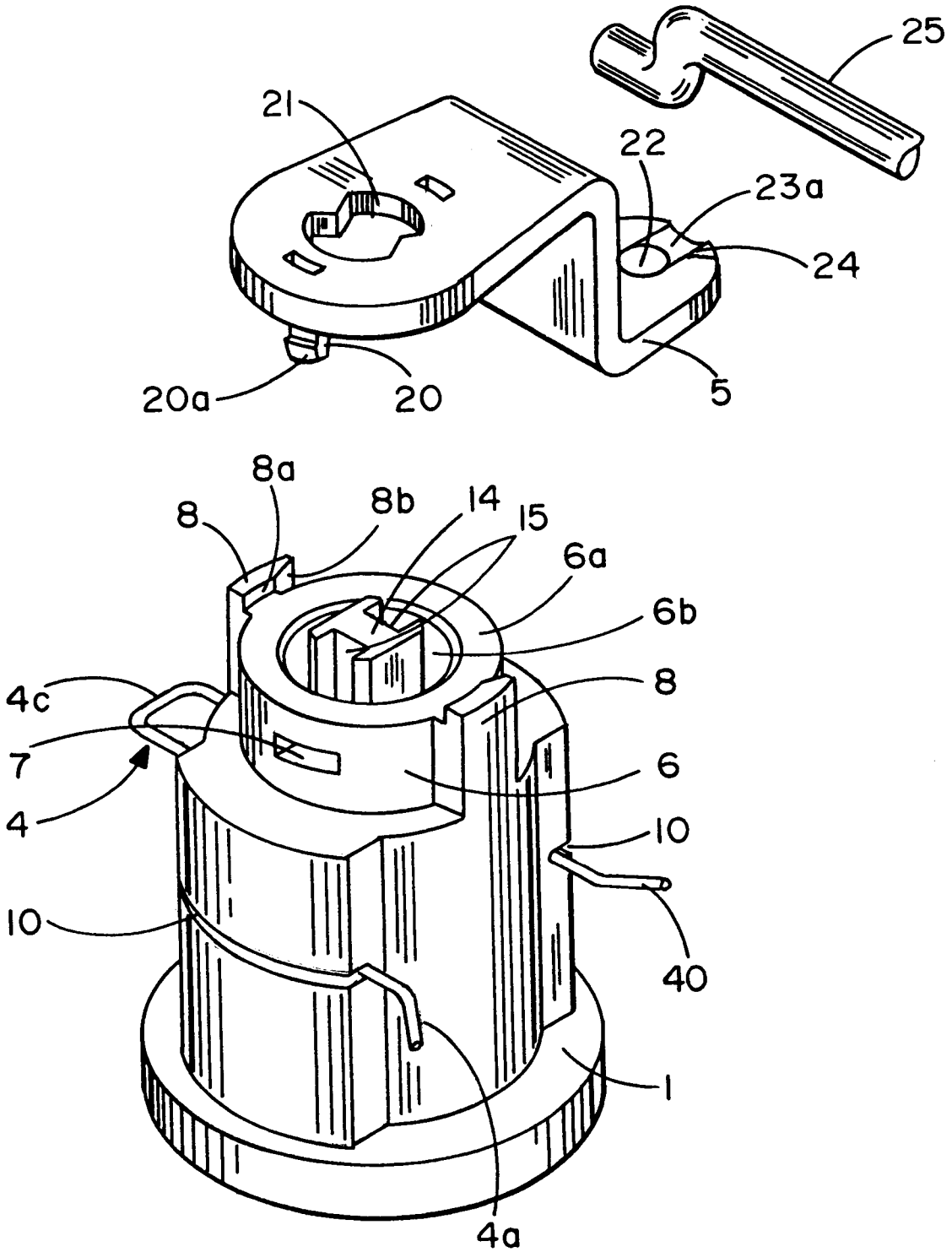

FIGS. 6 to 8 show an embodiment wherein the shaft 14 has an essentially H-shaped cross-section and such as to define relief pockets 15 which allow for the inward deflection of the latching tabs 20. That is to say, without some space for the inward deflection of the tabs 20, the lever would be very difficult to move until such time as the key cylinder was removed from the cavity 2.

Although the invention has been discussed in terms of a limited number of embodiments and/or variants, the various modifications and changes that can be made without departing from the scope of the invention, will be self-evident to one skilled in the art to which this invention pertains. Instead of being applied to compartment closure member locks, the key cylinder structure can be applied to ignition switches wherein the key lever is replaced and the shaft of the key cylinder connected with a switch mechanism and or a lock for the steering column. Further, the advantage of a dealer, for example, being able to set the key cylinders not only in the doors of a vehicle but also in the ignition switch, particularly in the instance wherein the same key is used to open the doors and to start the vehicle, is clear. The ability to use a key dummy for both the doors and the ignition prior to setting of the actual key cylinders, is also self-evident in light of the above description.

What is claimed is:

1. An automotive key assembly for an automobile comprising:

a key cylinder having a body with a predetermined length, a first key cylinder end, a second key cylinder end, and a shaft extending from the first key cylinder end, wherein the shaft is rotatable;

a key cylinder retention cavity having a first cavity end and a second cavity end, the key cylinder being receivable in the first cavity end, wherein the key cylinder retention cavity includes a body with an inner contour and an outer contour, the inner contour of the body enclosing the received key cylinder essentially along the entire the length of the key cylinder body, and wherein the key cylinder retention cavity includes an opening in the second cavity end, such that the shaft of the received key cylinder extends through the opening at the second cavity end of the cylinder retention cavity;

a rotatable member for transmitting the rotated motion of the key cylinder shaft, the rotatable member having key cylinder shaft engagement opening; and a rotatable connector for rotatably connecting the rotatable member to the key cylinder retention cavity;

wherein the key cylinder retention cavity and rotatable member are connectable and installable in the automobile prior to the cylinder retention cavity receiving the key cylinder, and wherein the key cylinder is receivable in the cylinder retention cavity after connection and installation of the key cylinder retention cavity and rotatable member, such that the shaft of the key cylinder engages the rotatable member;

wherein the key cylinder further comprises a key receiving opening at the second key cylinder end such that the shaft is rotatable by a received key rotated in the key receiving opening.

2. The automotive key assembly of claim 1, wherein the rotatable connector comprises a plurality of tabs extending from the rotatable member and a plurality of slots formed in the body of the key cylinder retention cavity, wherein the plurality of tabs are insertable into the plurality of slots, such that after insertion the rotatable member and the key cylinder retention cavity are connected and the plurality of tabs are slidable within the plurality of slots such that the rotatable member is rotatable relative to the key cylinder retention cavity.

3. The automotive key assembly of claim 1 further comprising a key cylinder retainer for retaining the key cylinder received within the key cylinder retention cavity.

4. An automotive key assembly for installation in a panel of an automobile comprising:

a key cylinder having a body with a predetermined length, a first key cylinder end, a second key cylinder end, and a shaft extending from the first key cylinder end, wherein the shaft is rotatable;

a key cylinder retention cavity having a first cavity end and a second cavity end, the key cylinder being receivable in the first cavity end, wherein the key cylinder retention cavity includes a body with an inner contour and an outer contour, the inner contour of the body enclosing the received key cylinder essentially along the entire the length of the key cylinder body, and wherein the key cylinder retention cavity includes an opening in the second cavity end, such that the shaft of the received key cylinder extends through the opening at the second cavity end of the cylinder retention cavity, and wherein the key cylinder retention cavity includes steps on the outer contour at the first end, such that a rigid connection forms between the key cylinder retention cavity and the panel of the automobile upon installation;

a rotatable member for transmitting the rotated motion of the key cylinder shaft, the rotatable member having a key cylinder shaft engagement opening; and a rotatable connector for rotatably connecting the rotatable member to the key cylinder retention cavity;

wherein the key cylinder retention cavity and rotatable member are connectable and installable in the automobile prior to the cylinder retention cavity receiving the key cylinder, and wherein the key cylinder is receivable in the cylinder retention cavity after connection and installation of the key cylinder retention cavity and rotatable member, such that the shaft of the key cylinder engages the rotatable member.

* * * * *